US007419243B2

(12) United States Patent
Desire et al.

(10) Patent No.: US 7,419,243 B2
(45) Date of Patent: Sep. 2, 2008

(54) DEVICE FOR CONVEYING AND GUIDING MAIL ITEMS

(75) Inventors: Régis Desire, Sceaux (FR); Hervé Duval, Paris (FR); Stéphane Legallo, Savigny sur Orge (FR); Philip Torres, Fontenay Aux Roses (FR)

(73) Assignee: NEOPOST Technologies, Bagneux (FR)

( * ) Notice: Subject to any disclaimer, the term of this patent is extended or adjusted under 35 U.S.C. 154(b) by 0 days.

(21) Appl. No.: 11/668,806

(22) Filed: Jan. 30, 2007

(65) Prior Publication Data

US 2007/0208675 A1 Sep. 6, 2007

(30) Foreign Application Priority Data

Jan. 31, 2006 (FR) ..... 0650334

(51) Int. Cl.
*B41J 2/145* (2006.01)
*B41J 2/15* (2006.01)

(52) U.S. Cl. ..... 347/40; 347/104

(58) Field of Classification Search ..... 347/40, 347/101, 104
See application file for complete search history.

(56) References Cited

U.S. PATENT DOCUMENTS 4,821,049 A 4/1989 Eckl
6,484,475 B1 * 11/2002 Neagle et al. ..... 53/167

FOREIGN PATENT DOCUMENTS

| | | |
|---|---|---|
| EP | 1 431 925 A2 | 6/2004 |
| FR | 2 742 693 | 6/1997 |
| FR | 2 788 506 | 7/2000 |
| FR | 2 790 997 | 9/2000 |

* cited by examiner

*Primary Examiner*—Thinh H Nguyen
(74) *Attorney, Agent, or Firm*—Sughrue Mion, PLLC

(57) ABSTRACT

The invention relates to a device for conveying and guiding mail items in a postage meter provided with an inkjet print head, in which postage meter each mail item, which has a top face and a bottom face, passes under the print head between a top reference surface defined by the bottom surface of a stationary guide plate and a bottom reference surface, said device having at least two drive assemblies mounted transversely side-by-side and to move vertically independently from each other, so that the top surfaces of the mail items remain continuously pressed against said stationary guide plate regardless of the thickness of the mail item, and in particular when said thickness varies over the width of the mail item.

6 Claims, 4 Drawing Sheets

DEVICE FOR CONVEYING AND GUIDING MAIL ITEMS

FIELD OF THE INVENTION

The present invention relates exclusively to the field of mail handling, and it relates more particularly to a device for conveying and guiding mail items, such as documents, envelopes, other types of cover, or labels, under an ink jet print head of a postage meter or "franking machine".

PRIOR ART

With ink jet technology, in the field of postal franking, a critical problem that arises is the problem of maintaining at a constant value the spacing between the ejection faces of the nozzles and the top face of the mail item that is to receive the postal imprint. In the postal field, such an imprint, which constitutes a monetary value must present printing quality that is as high as possible, in particular since, with the new postal standards currently applicable, the indicia present in the postal imprint are increasingly numerous (incorporating service data, advertising data, etc.) and complex (presence of two-dimensional codes).

In Patent Application FR 2 742 693, the Applicant has proposed a guide device that significantly improves the printing quality of ink-jet postage meters. However, in certain special cases, e.g. when envelopes enclose documents or inserts that are of uneven profiles, it appears, as shown in FIG. 7, that those envelopes are not correctly pressed against the top reference surface over their entire widths, and the distance (d1, d2) from the print head to the top surface of the envelope thus varies. In addition, such envelopes are subjected to a phenomenon of slewing and slippage that, by preventing them from being moved normally and rectilinearly as they go under the print head, affects the quality of the postage imprint that is printed.

OBJECT AND DEFINITION OF THE INVENTION

An object of the present invention is to provide a conveyor and guide device that removes the drawbacks of prior devices. Another object of the invention is to provide a device that is capable of handling envelopes regardless of their thicknesses or of their sizes. Yet another object of the invention is to propose a device that avoids the impacts and jolts that occur in conveying envelopes in prior art devices.

These objects are achieved by a device for conveying and guiding mail items in a postage meter provided with an inkjet print head, in which postage meter each mail item, which has a top face and a bottom face, passes under the print head between a top reference surface defined by the bottom surface of a stationary guide plate and a bottom reference surface, said device having at least two drive assemblies mounted transversely side-by-side and to move vertically independently from each other, so that the top surfaces of the mail items remain continuously pressed against said stationary guide plate regardless of the thickness of the mail item, and in particular when said thickness varies over the width of the mail item.

Thus, by means of this special structure, it is possible to accommodate the variations in thickness that can exist over the same envelope.

Preferably, each of said drive assemblies has a belt whose top surface forms said bottom reference surface and which is mounted over a set of pulleys, only one of which is driven, the other pulleys being left free and being rotated merely by said belt which connects them to said driven pulley. The driven pulleys of the drive assemblies are connected to a common drive shaft driven in rotation by a single motor.

Advantageously, each of said pulley assemblies forms a parallelogram system whose arms interconnect the axles of the various pulleys forming each drive assembly and which acts in opposition to resilient means, so that the belts remain continuously in contact with the bottom face of the mail item throughout the movement of said mail item through the postage meter.

In order to convey the mail items through the postage meter, said belts co-operate with backing rollers that face them, that are mounted to be free to rotate about their respective axes of rotation, and that come through to just beneath said bottom surface of the stationary guide plate.

In an advantageous embodiment, one of said arms of each of said parallelogram systems is connected to a drive shaft so as to enable each of said belts to move vertically in controlled manner.

BRIEF DESCRIPTION OF THE DRAWINGS

Other characteristics and advantages of the present invention appear more clearly from the following description given by way of non-limiting indication and with reference to the accompanying drawings, in which.

DETAILED DESCRIPTION OF A PREFERRED EMBODIMENT

Figure 1:
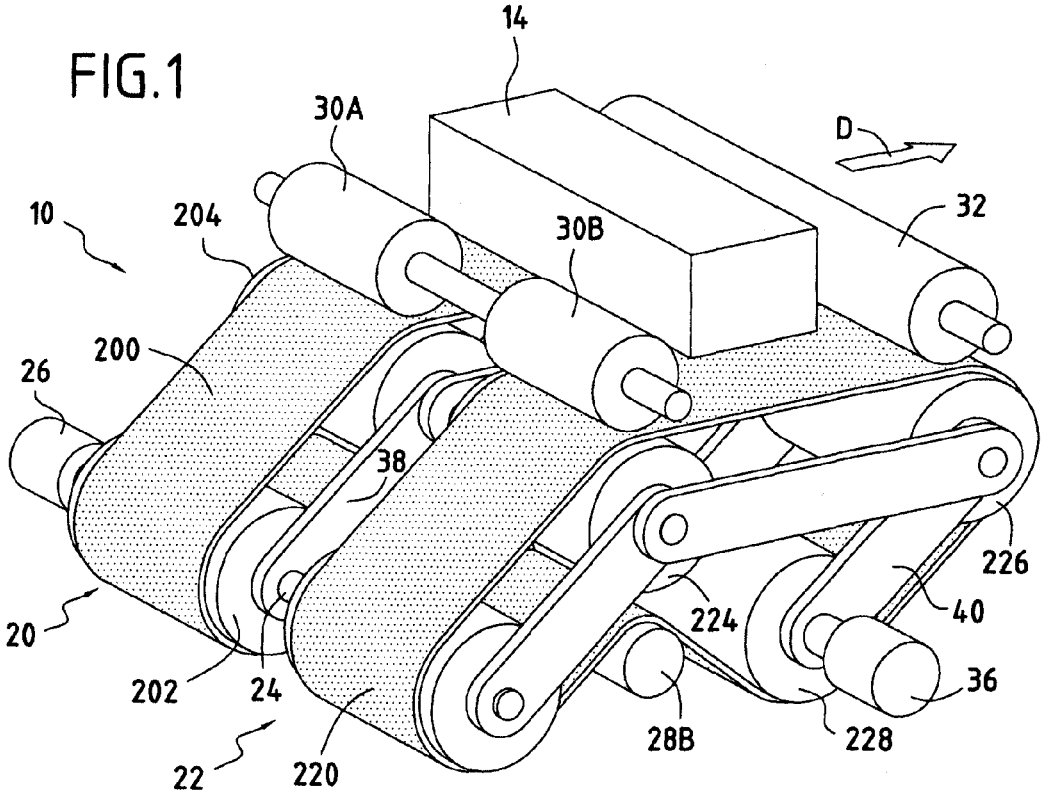
FIGS. 1 and 2 are respectively a perspective view and a section view showing, in a rest first position, a device of the invention for conveying and guiding mail items, which device is associated with an ink jet print head of a postage meter.
Figure 2:
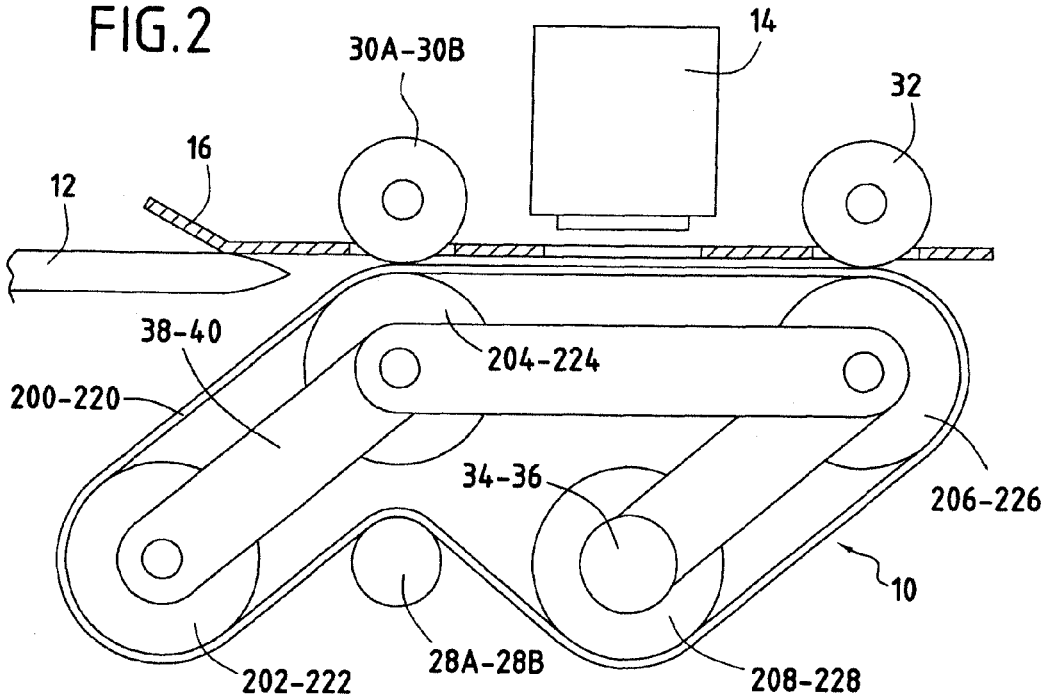
Figure 3:
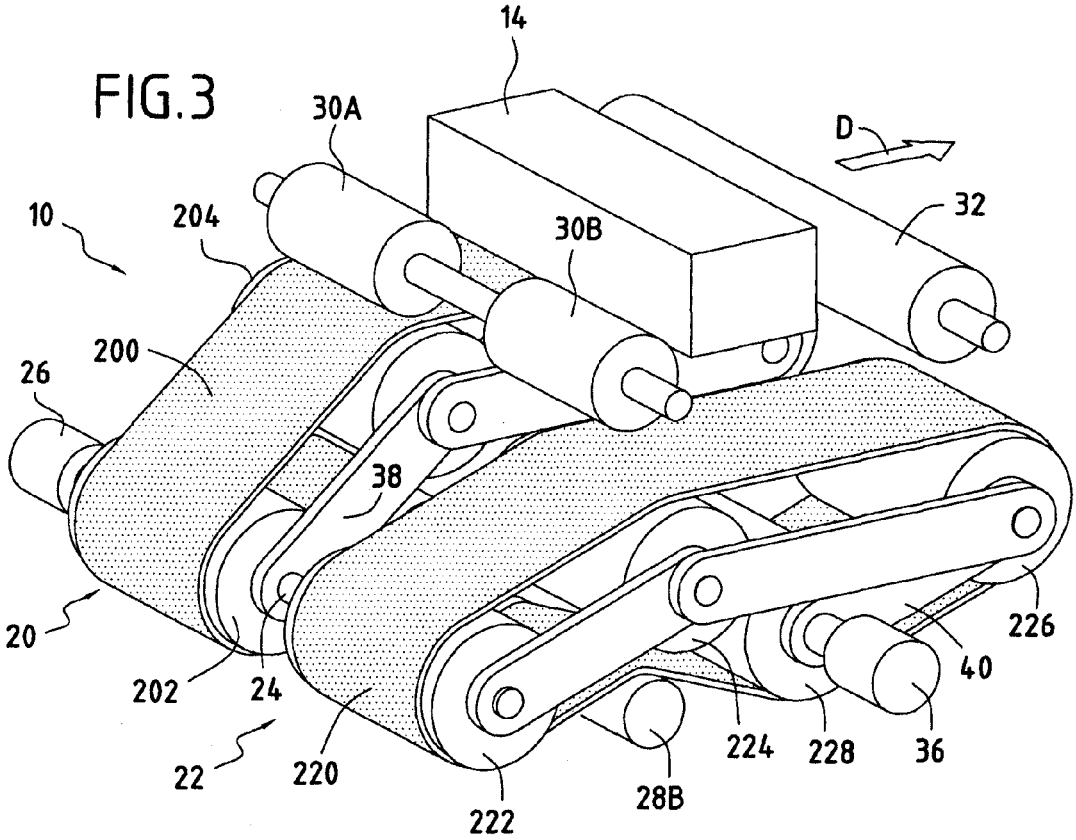
FIGS. 3 and 4 are respectively a perspective view and a section view showing, in a second position, a device of the invention for conveying and guiding mail items, which device is associated with an ink jet print head of a postage meter.
Figure 4:
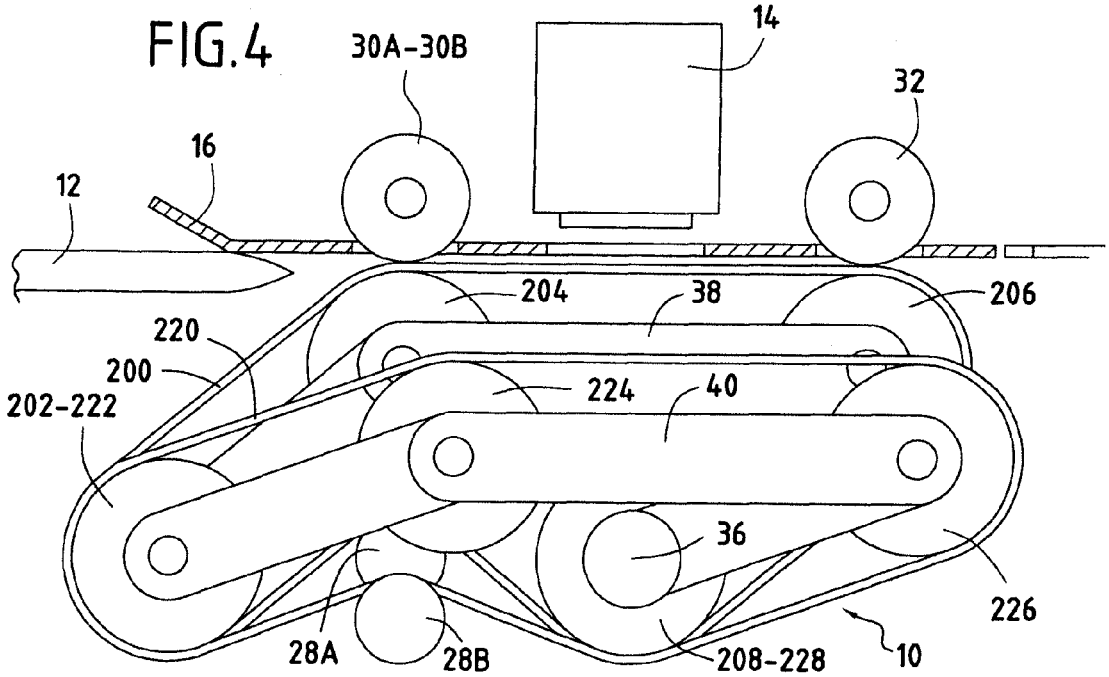

FIGS. 1 to 4 show a device 10 of the invention for conveying and guiding mail items such as an envelope 12 under an inkjet print head 14 of a postage meter. FIGS. 1 and 2 correspond to the device being in a rest position, in the absence of envelopes. FIGS. 3 and 4 correspond to an operating position, in the presence of an envelope of varying thickness and thus of uneven profile (the dimensions are exaggerated to enable the invention to be better understood).

As is known, below a stationary guide plate 16 (which is secured to the body of the postage meter) serving as a top reference surface for said mail items, this device has a plurality of drive assemblies disposed in planes parallel to the direction D in which the mail items move through the postage meter, which plurality of drive assemblies comprise at least a first drive assembly 20 and a second drive assembly 22, each preferably formed by a belt 200, 220 mounted on a set of pulleys and forming a bottom reference surface for said mail items.

The two drive assemblies are spaced apart by a space corresponding substantially to the width of a postal imprint. Naturally, it is possible, with the device of the invention, to add one or more drive assemblies similar to the above-mentioned drive assemblies, as a function of the type of postage meter or for holding more securely mail items of large dimensions, e.g. of A4 format.

For a given drive assembly 20 or 22, only one pulley 202 or 222 of the four pulleys that exist is a driven pulley (preferably the pulley that is furthest upstream relative to the direction of movement of the mail items) and connected to a common drive shaft 24 that is driven in rotation by a single motor 26. The other three pulleys 204, 206, 208, or 224, 226, 228 which are not secured to the drive shaft are left free and are caused to rotate merely by the belt 200 or 220 that connects them to the driven pulley. Tensioner rollers 28A, 28B are also provided as is known so as to guarantee that the tension of each of the belts remains constant.

In order to convey the mail items, each of the two belts of the drive assemblies co-operates with a set of backing rollers 30A, 30B, 32 disposed upstream and downstream from the print head 14, above said belts while passing locally through the stationary guide plate 16 (they come through to just beneath said plate, in order to enable the mail item to be driven). Since these backing rollers are free to rotate about their respective axes, they are driven freely in rotation as the mail items advance, which mail items are themselves driven in translation by the two belts.

In accordance with the invention, in order to accommodate as well as possible the differences in thickness that can exist in the same mail item, the first and second drive assemblies are moved vertically independently from each other by means of a parallelogram system 38, 40 whose arms interconnect the axles of the various pulleys of each drive assembly. The parallelogram system also makes it possible to guarantee that the surfaces of the belts always remain parallel to the guide plate. Each parallelogram system acts in opposition to resilient means (not shown) so that the belts can remain continuously in contact with the bottom face of the mail item throughout the movement of said mail item along the guide path.

Figure 5:
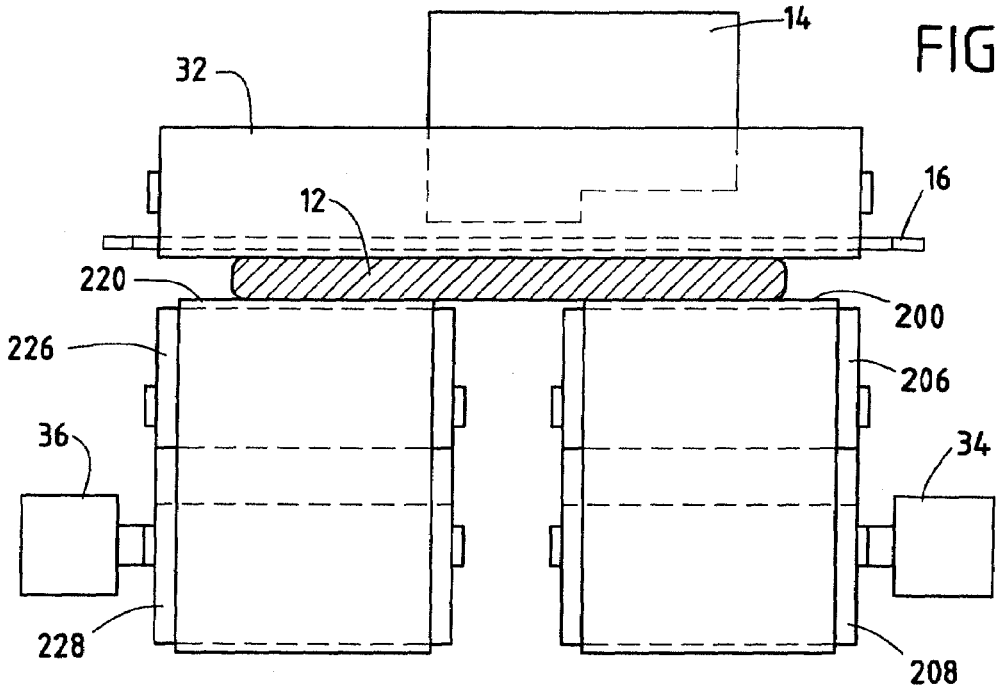
FIG. 5 shows, in the position of FIGS. 1 and 2, an envelope at the outlet of the device of the invention for conveying and guiding mail items.
Figure 6:
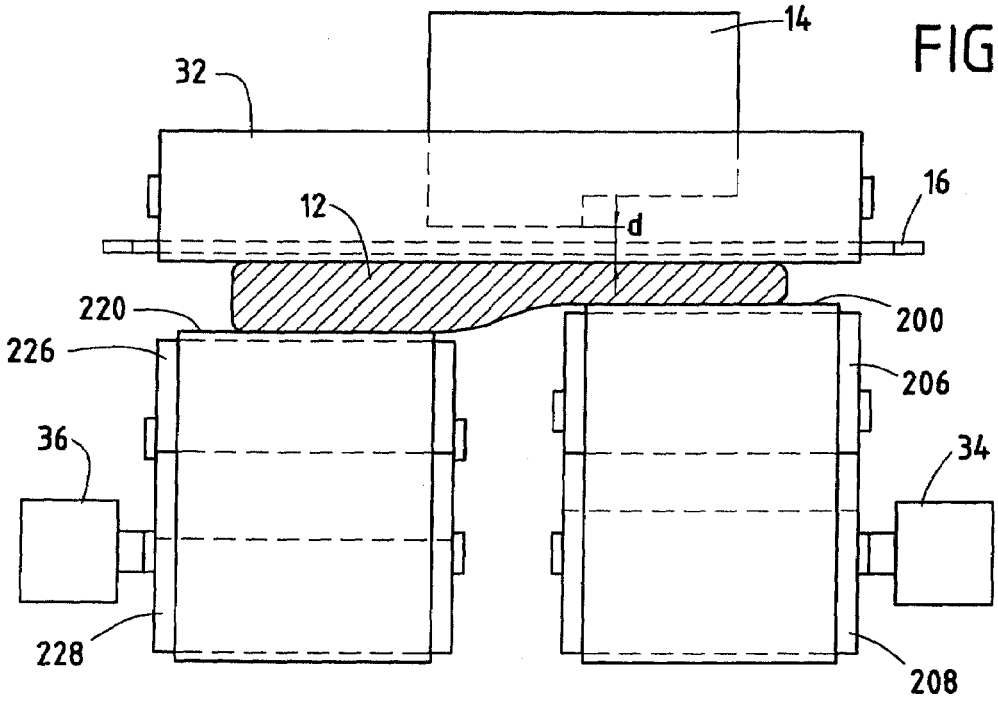
FIG. 6 shows, in the position of FIGS. 3 and 4, an envelope at the outlet of the device of the invention for conveying and guiding mail items.
Figure 7:
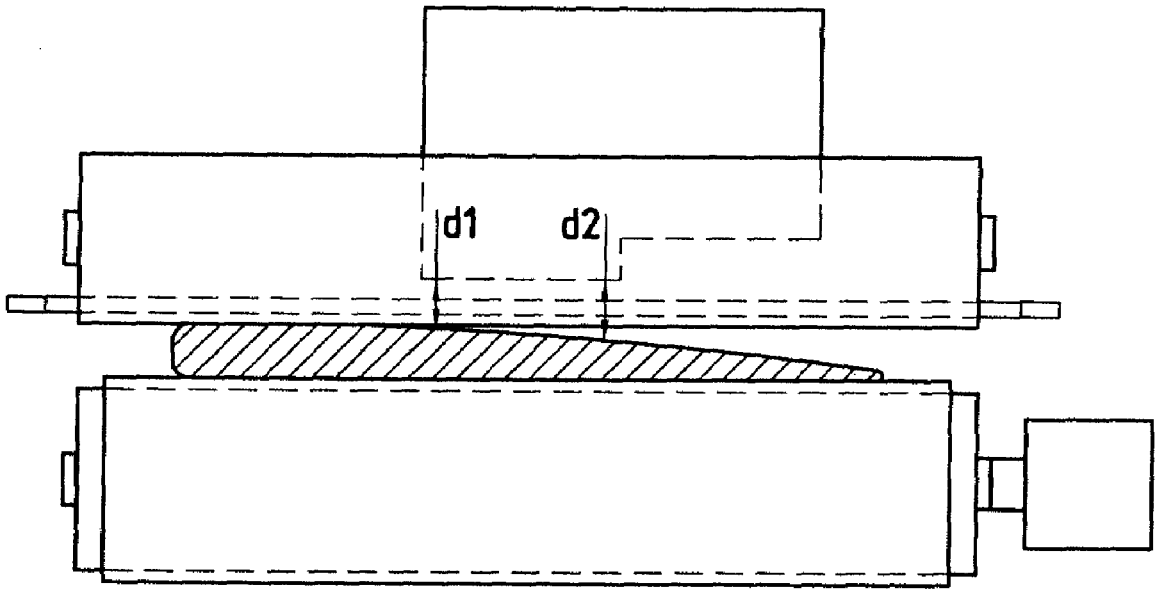
FIG. 7 PRIOR ART
FIG. 7 shows an envelope at the outlet of a prior art device for conveying and guiding mail items.

Operation of said device can be described very simply as follows with reference to FIGS. 5 and 6 which show a mail item exiting from the device of the invention in the two positions of FIG. 1 and of FIG. 3 (or of FIG. 2 and of FIG. 4).

Consideration is given below to a mail item 12 coming from a feeder module (not shown) situated upstream from the device 10. This mail item, e.g. formed of an envelope enclosing a bundle of documents of constant thickness, is about to enter a guide and conveyor path formed between the top surfaces of the belts 200, 220 of the drive assemblies and the bottom surface of the stationary guide plate 16. Under the action of these belts, which are motor-driven via the common drive shaft 24 actuated by the motor 26, the envelope is driven in the direction D of movement and shifts the belts away from their initial high positions by a distance corresponding to the thickness of the envelope. Then, under continued propulsion from the belts, the envelope passes under the print head 14, and once printing has been performed, is removed to a sending module (not shown).

Throughout the conveying, the distance between the ejection surfaces of the nozzles of the print head and the top surface of the conveyed envelope is kept constant, at a predetermined optimum value that is dependent on the characteristics of the head, regardless of the thickness of said envelope, due to the action of the parallelogram system which exerts continuous stress on the bottom surface of the envelope, under the effect of resilient means (return springs that are not shown), and due to the action of the stationary guide plate that acts as a reference abutment for the top surface of said envelope.

When the envelope inserted into the device of the invention has a thickness that is not constant over its entire width, the first and second drive assemblies move vertically to mutually different extents for conveying said envelope to the print zone and for then removing it therefrom. In the example shown in FIG. 6 (see also FIGS. 3 and 4), said envelope entering the guide path causes the belt 200 of the first drive assembly to be moved away to an extent different from the extent to which the belt 220 of the second drive assembly is moved away, thereby causing the envelope to move rectilinearly. The inevitable slewing in the guiding of the envelope by prior art single drive assemblies is avoided by this independent drive which, in addition, by re-establishing a plane top surface of the envelope, guarantees improved referencing, and, by keeping the distance d to the print head constant, guarantees excellent printing quality.

It should also be noted that in order to avoid impacts between the leading edges of the envelopes and the pulleys 204, 224 as said envelopes arrive, provision is made for the drive assemblies to be driven vertically by separate motors 34, 36 designed to cause the belts to be moved vertically individually in controlled manner. For this purpose, it suffices to open up the guide path by lowering the belts by a distance corresponding at the most (so as to avoid any slippage) to the maximum thickness of the envelope as determined previously upstream, e.g. at the device for selecting said envelopes.

What is claimed is:

1. A device for conveying and guiding mail items in a postage meter provided with an inkjet print head, in which postage meter each mail item, which has a top face and a bottom face, passes under the print head between a top reference surface defined by the bottom surface of a stationary guide plate and a bottom reference surface, said device having at least two drive assemblies mounted transversely side-by-side and to move vertically independently from each other, so that the top surfaces of the mail items remain continuously pressed against said stationary guide plate regardless of the thickness of the mail item, and in particular when said thickness varies over the width of the mail item.

2. A device according to claim 1, wherein each of said drive assemblies comprises a belt whose top surface forms said bottom reference surface and a set of pulleys over which is mounted the belt, only one of said pulleys being a driven pulley, the other of said pulleys being left free and being rotated merely by said belt which connects them to said driven pulley.

3. A device according to claim 2, wherein the driven pulleys of the drive assemblies are connected to a common drive shaft driven in rotation by a single motor.

4. A device according to claim 2, wherein each of said drive assemblies forms a parallelogram shaped system having arms interconnecting axles of the set of pulleys forming each drive assembly and which is resiliently urged towards the stationary guide plate by a resilient means cooperating with the arms, so that the belts of each of said drive assemblies remain continuously in contact with the bottom face of the mail item throughout the movement of said mail item through the postage meter.

5. A device according to claim 4, wherein one of said arms of each of said parallelogram systems is connected to a drive shaft so as to enable each of said belts to move vertically in controlled manner.

6. A device according to claim 2, wherein, in order to convey the mail items through the postage meter, said belts co-operate with backing rollers that face them, that are mounted to be free to rotate about their respective axes of rotation, and that come through to just beneath said bottom surface of the stationary guide plate.

* * * * *